US005415219A

United States Patent [19]

Wiedenmann et al.

[11] Patent Number: 5,415,219

[45] Date of Patent: May 16, 1995

[54] GRID CASTING MOLD FOR THE CASTING OF LEAD GRIDS FOR ACCUMULATORS AND METHODS FOR ITS MANUFACTURE

[75] Inventors: Reinhold Wiedenmann, Lippstadt; Karl-Christoph Berger, Bad Sassendorf; Eberhard Nann, Soest/Westfalen, all of Germany

[73] Assignee: Hagen Batterie AG, Soest/Westfalen, Germany

[21] Appl. No.: 94,601

[22] Filed: Jul. 20, 1993

[30] Foreign Application Priority Data

Jul. 21, 1992 [DE] Germany ..... 42 24 078.6

[51] Int. Cl.[6] ..... B22C 1/00

[52] U.S. Cl. ..... 164/138; 164/17; 164/72; 164/DIG. 1; 249/80

[58] Field of Search ..... 249/60, 80; 164/6, DIG. 1, 164/122, 14, 17, 72, 138

[56] References Cited

U.S. PATENT DOCUMENTS

| | | | |
|---|---|---|---|
| 2,903,375 | 9/1959 | Péras . | |
| 3,779,816 | 12/1973 | Mao | 164/138 |
| 3,789,910 | 2/1974 | Matter et al. | 164/122 |
| 4,085,792 | 4/1978 | Eberle | 164/72 |
| 4,903,753 | 2/1990 | Golz | 164/122 |
| 5,108,668 | 4/1992 | Kallup | 164/17 |

FOREIGN PATENT DOCUMENTS

| | | | |
|---|---|---|---|
| 0065996 | 12/1982 | European Pat. Off. | 249/60 |
| 0174613 | 3/1986 | European Pat. Off. . | |
| 0219610 | 4/1987 | European Pat. Off. . | |
| 0543444 | 5/1993 | European Pat. Off. | 164/138 |
| 2355649 | 5/1974 | Germany . | |
| 2355650 | 5/1974 | Germany . | |
| 3040960C2 | 5/1981 | Germany . | |
| 3529725A1 | 3/1987 | Germany . | |
| 3533581A1 | 4/1987 | Germany . | |
| 3603657A1 | 10/1987 | Germany . | |
| 61-286037 | 12/1986 | Japan | 164/138 |
| 2187252 | 7/1990 | Japan | 249/60 |
| 2100636 | 1/1983 | United Kingdom | 164/138 |
| 325651 | 1/1992 | U.S.S.R. . | |

*Primary Examiner*—P. Austin Bradley
*Assistant Examiner*—James Miner
*Attorney, Agent, or Firm*—Townsend and Townsend Khourie and Crew

[57] ABSTRACT

A grid casting mold for the casting of accumulator lead grids has two plates (11, 12) which can be placed against one another with a casting profile (13) or mold cavity complementary to the lead grid which is to be manufactured being formed in their confronting mold surfaces. The plates (11, 12) moreover have a base body (14, 15) which is provided at the profile side with a thermally insulating layer (16, 17) of high temperature fiber ceramic material which is coated on the side remote from the base body (14, 15) with a high wear resistant metal oxide (18, 19).

19 Claims, 1 Drawing Sheet

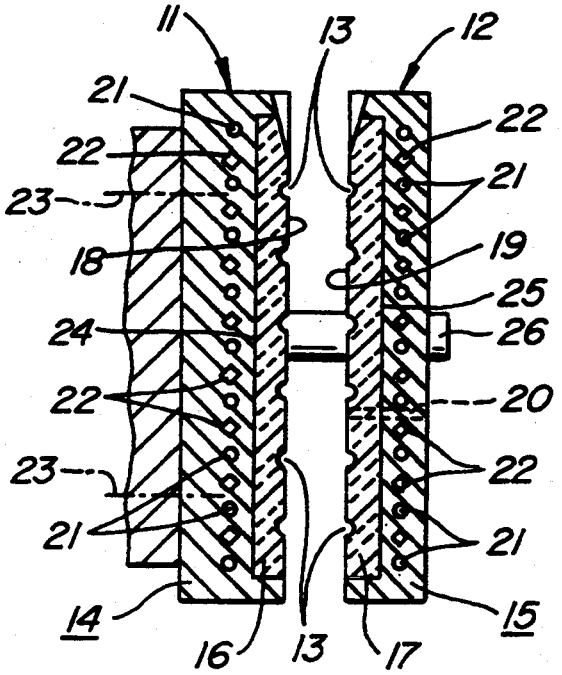
11
13
12
21
22
22
21
23
18
19
25
24
26
22
20
23
22
21
21
14
16
13
17
15

GRID CASTING MOLD FOR THE CASTING OF LEAD GRIDS FOR ACCUMULATORS AND METHODS FOR ITS MANUFACTURE

BACKGROUND OF THE INVENTION

The invention relates to a grid casting mold for the casting of lead grids for accumulators comprising two plates which can be placed against one another with a casting profile or mold cavity complementary to the lead grid which is to be cast being provided in their confronting mold surfaces, and also relates to a method for its manufacture.

For the manufacture of lead grids for accumulators in gravity castings use is generally made of such grid casting molds of steel and grey cast iron. The geometry of the lead grid to be manufactured is introduced into the base body by chip forming machining with a certain extra clearance for the thermally insulating layer which is to be applied in a pressurised air spraying process and which consists of cork flour with grain sizes of less than 200 mesh which are dispersed with a binder, for example water glass or Relatin (a registered trade mark of the German Henkel company), i.e. carboxymethyl celluloses. The suspension of cork flour and binder is applied onto the mold surface of the base body which is already provided with the casting profile by means of a spray device. The layer thickness of the thermally insulating layer amounts to ca. 0.15 mm. The thermally insulating layer simultaneously satisfies the function of a mold parting or release agent.

The tempering of the mold which is necessary in order to obtain the corresponding manufacturing parameters takes place through cooling channels which are provided in the base body through which a suitable fluid is directed. At the start of work the casting mold is brought up to the desired temperature level by appropriate auxiliary heating means. The lead grid is then cast and, after a certain time, the mold is cooled by the introduction of a cooling agent into the cooling passages. The thermal insulating layer thereby prevents too rapid solidification of the lead melt.

A problem with the known grid casting mold lies in the fact that the lifetime of the thermally insulating layer which has been applied is restricted and in the fact that the weight of the lead grid which is manufactured can change due to continuous wear. This requires, also in dependence on the type of product being produced, a repair of the insulating layer or indeed the removal and complete new application of the latter daily.

The cause of the wear or the die-coating material is the high thermal loading due to the operating temperature of the mold and the melt temperature, and also the flow speed of the liquid lead alloy.

The casting molds are built up in accordance with the geometry of the grid from two plates of for example 30 to 50 mm thickness. Cast iron with spherical graphite or, for less demanding molds, the more favorably priced and easier to procure grey cast iron are also suitable as material for the casting mold.

A method of manufacturing an apparatus for the casting of lead grids for electrical accumulator plates is already known (German laying open prints 35 29 725 A1 and 36 03 657 A1) in which the apparatus contains ceramic material the surface of which forms the casting mold and which stands in direct contact with the molten material entering into the die, with the ceramic material having a high porosity and being manufactured by flame spraying. The flame-sprayed ceramic layer is matched by mechanical material removing machining to the exact contour of the cast part. An intermediate layer located between the base body and the metal oxide layer serves as a bond promotor. The disadvantage of the known method is, on the one hand, the lack of thermal insulation and, on the other hand, the requirement for subsequent mechanical machining of the hard ceramic layer.

Furthermore a casting mold consisting of two mold halves for the manufacture of grid plates for lead accumulators is already known which are inserted as a negative form into the respective parts of an outer metallic mold carrier (EP 219 610 B1), with the casting mold being formed from a highly porous mat of microfibers. This prior known highly porous fiber mat mold requires no further surface treatment with a separating agent or insulating material for the metal casting. The micro fleece molds are not free from wear, they can however be rapidly exchanged for a new mold pair. The fiber fleece molds are thus consciously manufactured so that they only have a restricted working life.

SUMMARY OF THE INVENTION

The invention seeks to provide a further grid casting mold for the casting of lead grids for accumulators by gravity or pressure die-casting methods which serve as a carrier for the active material in lead acid batteries. It is in particular the aim of the invention to provide a grid casting mold the thermal insulating layers of which do not have to be subsequently treated or renewed throughout the entire life or working life, with it however being possible to manufacture problem-free, reproducable lead grids throughout the entire working life of the casting mold, and indeed with a not substantially reduced casting cycle time.

The use of, or post treatment with, a separating agent should not be necessary with the casting mold of the invention.

In order to satisfy this object the present invention provides a grid casting mold for the casting of lead grids for accumulators, the mold comprising two plates which can be placed against one another with a casting profile or mold cavity complementary to the lead grid which is to be cast being provided in their confronting mold surfaces, and which have:

- a base body corresponding in its areal extent to the lead grid which is to be manufactured and which preferably consists of grey cast iron,
- a thermally insulating layer of high temperature fiber ceramic being arranged on the surface of the base body facing the profile, and
- a coating of a high wear-resistant metal oxide arranged on the surface of the insulating layer remote from the base body.

The metal oxide layers which are applied in accordance with the invention by plasma spraying, in particular metal oxide layers of $Al_2O_3$ or $ZrO_2$ are characterised by their high resistance to wear and durable shape. The high temperature or refractory fiber ceramic layer which is located beneath it prevents in addition a too rapid dissipation of the heat contained in the lead melt, whereby the lead melt is kept liquid for a longer period of time. The high temperature fiber ceramic has the advantage that it can bear mechanical forces, which occur during the subsequent application of the metal oxide layer by plasma spraying, without the danger of deformation, so that the complementary grid geometry introduced into the fiber ceramic layer is also fully maintained during the spraying on of the metal oxide layer.

Thus, in accordance with the invention, the region around the mold surfaces of the casting mold is formed in a sandwich construction with the surface consisting of $Al_2O_3$ of $ZrO_2$ having the highest mechanical strength, whereas the subsequent fiber ceramic layer forms the actual body determining the casting geometry and ensures the highest thermal insulation with adequate mechanical strength. The base body of the casting mold can consist of simple grey cast iron or of globular graphite casting, or a steel, so that it has the required mechanical strength for receiving the mold guiding elements, cooling channels, thermosensors, ejectors, die-mounting elements etc.

In order to ensure a uniform filling process venting slits are provided in the casting molds. Such venting slits can also be provided with the sandwich construction of the invention.

Porous structure in the metal oxide layer, and also however in the fiber ceramic layer, can for example be obtained by the chemical leaching out of specific oxides, metal particles or thermally stable organic compounds which are added to the actual sprayed material and to the fiber ceramic layer respectively. By way of example, oxides which are readily soluble in dilute acid, for example magnesium oxide, or metal particles or organic compounds which are readily soluble in organic solvants, but are otherwise heat resistant, can for example be considered here. Porous layers can also be obtained by the addition of carbon particles in the form of graphite which are subsequently oxidised to $CO_2$.

BRIEF DESCRIPTION OF THE DRAWING

The invention will now be described in the following by way of example and with reference to the drawing, the single figure of which shows a schematic section of a grid casting mold in accordance with the invention.

DESCRIPTION OF THE PREFERRED EMBODIMENT

In accordance with the drawing the two plates 11, 12 of a casting mold of the invention contain cooling channels 21 and heating means 22 by means of which the plates can be respectively brought to a temperature suitable for a specific stadium of the casting process.

Whereas the left plate 11 in the drawing is also provided with only schematically indicated ejectors and mold fastener means 23 the right plate 12 shown in the drawing can be swung away from the plate 11 around a non-illustrated hinge in order to remove the finished lead grid from the mold. The structure on which the two plates 11, 12 are exactly positioned relative to one another is indicated at 26.

Each plate 11, 12 consists of a base body 14, 15 respectively of grey cast iron. Recesses 24 and 25 are provided in the mutually confronting surfaces of the base bodies 14 and 15 respectively and extend over the entire casting region of the mold. High temperature fiber ceramic layers 16, 17 are introduced into the recesses 24, 25 and are secured there in a suitable manner. The connection surfaces between the base bodies 14, 15, on the one hand, and the high temperature fiber ceramic layers 16, 17, on the other hand, are made essentially planar (flat). The thickness of the fiber ceramic layer 16, 17 is about 10 mm.

The casting profile 13 corresponding to the lead grid to be manufactured, together with an additional clearance for a metal oxide layer which is to be subsequently applied, is machined into the mutually confronting surfaces of the fiber ceramic layers 16, 17.

Thereafter a metal oxide layer 18 or 19 approximately 0.5 mm thick is applied by plasma spraying to the fiber ceramic layers 16, 17 respectively and forms the surface in which the casting profile 13 is provided.

Whereas the metal oxide layer 18, 19 which consists in particular of $Al_2O_3$ or $ZrO_2$ takes care of high wear resistance and durability of shape of the casting profile, the fiber ceramic layer 16, 17 prevents too rapid cooling of the molten lead which is introduced into the casting mold during manufacture of the lead grid. Moreover, the fiber ceramic layer is adequately firm and strong in order to withstand, on the one hand the spraying on of the metal oxide powder by plasma spraying without deformation and also to form an adequately firm substrate for the metal oxide layer which is subsequently applied.

The fiber ceramic layer can be secured to the base body 14, 15 of grey cast iron either with a mechanical clamping frame or by means of clamping bolts, or can be pushed into grooves which are provided in the base body and bonded in place. A combination of both methods can also be considered.

The surface structure of a grid manufactured in accordance with the invention is particularly fine-grained and leads to a large contact area between the grid and the mass, i.e. the material applied in use to the grid plates.

We claim:

1. A method of manufacturing a grid casting mold comprising the steps of:

providing first and second metal base bodies having profile sides facing each other;

applying a thermally insulating layer of fiber ceramic to the profile side of each base body;

plasma spraying a layer of metallic oxide onto a surface of each fiber ceramic layer remote from the base body;

before the plasma spraying step, machining a casting profile into the surface of each fiber ceramic layer, each casting profile being machined to account for the layer of metallic oxide;

introducing a soluble oxide into each layer of metallic oxide; and after the plasma spraying step, dissolving the soluble oxide from each layer of metallic oxide to provide a porous outer layer.

2. The method of claim 1 further including introducing soluble oxides into the fiber ceramic layers and dissolving the soluble oxides out of the fiber ceramic layers after the fiber ceramic layers have been applied to the metal base bodies to form a porous intermediate layer.

3. A method of manufacturing a grid casting mold comprising the steps of:

providing first and second metal base bodies having profile sides facing each other;

applying a thermally insulating layer of fiber ceramic to the profile side of each base body;

plasma spraying a layer of metallic oxide onto a surface of each fiber ceramic layer remote from the base body;

before the plasma spraying step, machining a casting profile into the surface of each fiber ceramic layer, each casting profile being machined to provide space for the layer of metallic oxide;

introducing graphite into each layer of metallic oxide; and after the plasma spraying step, oxidizing the graphite into carbon dioxide to provide a porous outer layer.

4. The method of claim 3 further including introducing graphite into the fiber ceramic layers and oxidizing the graphite out of the fiber ceramic layers after the fiber ceramic layers have been applied to the metal base bodies to form a porous intermediate layer.

5. A method of manufacturing a grid casting mold comprising the steps of:

providing first and second metal base bodies having profile sides facing each other;

forming first and second thermally insulating layers of fiber ceramic in a manufacturing mold, the fiber ceramic layers each having a flat side and a profile side opposite the flat side, each profile side having a surface with a casting profile, the casting profile being machined to provide space for a layer of metallic oxide on the surface of the fiber ceramic;

applying the flat sides of the fiber ceramic layers to the profile sides of the metal base body;

introducing a soluble oxide into a metallic oxide;

plasma spraying the layers of metallic oxide onto the surfaces of the fiber ceramic layers; and dissolving the soluble oxide from the layers of metallic oxide to provide a porous outer layer.

6. The method of claim 5 further including introducing soluble oxides into the fiber ceramic layers and dissolving the soluble oxides out of the fiber ceramic layers after the fiber ceramic layers have been applied to the metal base bodies to form a porous intermediate layer.

7. A method of manufacturing a grid casting mold comprising the steps of:

providing first and second metal base bodies having profile sides facing each other;

forming first and second thermally insulating layers of fiber ceramic in a manufacturing mold, the fiber ceramic layers each having a flat side and a profile side opposite the flat side, each profile side having a surface with a casting profile, the casting profile being machined to account for a layer of metallic oxide on the surface of the fiber ceramic layer;

applying the flat sides of the fiber ceramic layers to the profile sides of the metal base body;

introducing graphite into the layers of metallic oxide;

plasma spraying the layers of the metallic oxide to the surfaces of the fiber ceramic layers; and oxidizing the graphite into carbon dioxide to provide a porous outer layer.

8. The method of claim 7 further including introducing graphite into the fiber ceramic layers and oxidizing the graphite out of the fiber ceramic layers after the fiber ceramic layers have been applied to the metal base bodies to form a porous intermediate layer.

9. A method of manufacturing a grid casting mold having finished molding surfaces comprising the steps of:

providing first and second metal base bodies having generally flat surfaces facing each other;

applying a thermally insulating layer of porous fiber ceramic to the flat surface of each base body;

plasma spraying a layer of metallic oxide to a surface of each ceramic fiber layer remote from the base body; and before the plasma spraying step, machining a casting profile into the surface of each fiber ceramic layer, the casting profile being machined to provide space for a thickness of the layer of metallic oxide whereby a free surface of the metallic oxide defines the finished molding surfaces.

10. The method of claim 9 wherein the fiber ceramic layers have a thickness sufficient to provide a flat surface opposite the casting profile surfaces.

11. The method of claim 9 wherein the fiber ceramic layers are 5–30 times thicker than the layers of metal oxide.

12. The method of claim 9 wherein the fiber ceramic layers are 10–20 times thicker than the layers of metal oxide.

13. The method of claim 9 wherein the layers of metallic oxide are thin enough to conform to the casting profiles on the fiber ceramic layers.

14. The method of claim 9 wherein the fiber ceramic layers consist of 80–95 percent aluminum and 5–20 percent silicon oxide.

15. The method of claim 9 wherein the metallic oxide layer is selected from the group consisting of aluminum oxide and zirconium oxide.

16. The method of claim 9 wherein the fiber ceramic layers are 0.2 to 15 mm thick.

17. The method of claim 9 wherein the layers of metallic oxide are 0.01 to 0.8 mm thick.

18. The method of claim 9 further including the step of forming air discharge channels through the metal base bodies and the fiber ceramic layers, the layers of metal oxide being porous.

19. A method of manufacturing a grid casting mold comprising the steps of:

providing first and second metal base bodies having generally flat surfaces facing each other;

forming first and second thermally insulating layers of porous fiber ceramic in a manufacturing mold, the fiber ceramic layers each having a flat side and a profile side opposite the flat side, the profile side having a surface with a casting profile machined to provide space for a thickness of a layer of metallic oxide on the surface;

applying the flat sides of the fiber ceramic layers to the flat surfaces of the metal base bodies; and plasma spraying the layers of metallic oxide to the profile sides of the fiber ceramic layers.

* * * * *